US012779521B2

(12) United States Patent
Kaya

(10) Patent No.: US 12,779,521 B2
(45) Date of Patent: Nov. 3, 2026

(54) DEVICE FOR FLANGING A TUBE END

(71) Applicant: Harro Höfliger Verpackungsmaschinen GmbH, Allmersbach im Tal (DE)

(72) Inventor: Necati Kaya, Leutenbach (DE)

(73) Assignee: Harro Höfliger Verpackungsmaschinen GmbH, Allmersbach im Tal (DE)

( * ) Notice: Subject to any disclaimer, the term of this patent is extended or adjusted under 35 U.S.C. 154(b) by 181 days.

(21) Appl. No.: 18/672,839

(22) Filed: May 23, 2024

(65) Prior Publication Data

US 2024/0390968 A1 Nov. 28, 2024

(30) Foreign Application Priority Data

May 25, 2023 (EP) ..... 23175274

(51) Int. Cl.
*B21D 19/04* (2006.01)

(52) U.S. Cl.
CPC ..... *B21D 19/046* (2013.01)

(58) Field of Classification Search
CPC ..... B21D 17/04; B21D 19/04; B21D 19/06; B21D 19/046; B21D 19/02043; B21D 19/12; B21D 51/2615; B21D 51/263
See application file for complete search history.

(56) References Cited

U.S. PATENT DOCUMENTS

| | | | | |
|---|---|---|---|---|
| 4,143,535 | A | 3/1979 | Bouman | |
| 7,464,573 | B2 * | 12/2008 | Shortridge | B21D 51/2615 72/94 |
| 7,721,579 | B2 * | 5/2010 | Bartlett | B21D 5/08 72/181 |
| 11,498,112 | B1 * | 11/2022 | Diels | B21D 19/046 |
| 11,731,183 | B2 * | 8/2023 | Gearhart | B21D 1/08 72/67 |
| 2007/0017089 | A1 | 1/2007 | Hosoi | |
| 2013/0133390 | A1 | 5/2013 | Leppaenen et al. | |
| 2015/0360280 | A1 | 12/2015 | Yoo et al. | |
| 2019/0299264 | A1 | 10/2019 | Yoo et al. | |

FOREIGN PATENT DOCUMENTS

| | | | |
|---|---|---|---|
| CN | 101394951 | A | 3/2009 |
| CN | 104185516 | A | 12/2014 |
| CN | 215279605 | U | 12/2021 |
| JP | H10146623 | A | 6/1998 |
| JP | 2011050965 | A | 3/2011 |
| WO | 2011141638 | A1 | 11/2011 |

* cited by examiner

*Primary Examiner* — Matthew Katcoff
(74) *Attorney, Agent, or Firm* — Smartpat PLC

(57) ABSTRACT

A device (10) for flanging a tube end has a receiving unit for the workpiece (12) to be flanged and at least one tool holder (30). Provision is furthermore made for at least one flanging roller (34), which is fastened to the tool holder (30) by way of a spindle (32). The flanging roller (34) can rotate about an axis of rotation (36) along the longitudinal axis of the spindle (32). The longitudinal axis (22) of the receiving unit (20) and the axis of rotation (36) of the flanging roller (34) are oriented at an angle relative to one another.

12 Claims, 5 Drawing Sheets

DEVICE FOR FLANGING A TUBE END

CROSS-REFERENCE TO RELATED APPLICATION

This application claims the benefit of European Patent Application EP 23175274.2, filed on May 25, 2023, the contents of which is incorporated in its entirety.

TECHNICAL FIELD

The disclosure relates to a device for flanging a tube end. This involves bending the edge of a sheet or of a tube end by means of a corresponding device or manually. This makes it possible to prevent sharp cut edges, for example. It is also possible to close a tube end by means of flanging.

BACKGROUND

Devices for flanging a tube end are generally known. Generally, devices of this kind have a receiving unit for the workpiece to be flanged. This receiving unit can be rotated about a first axis of rotation. Provision is furthermore made for a tool holder, to which at least one flanging roller and at least one beading roller are fastened by way of a common spindle. The at least one flanging roller and the at least one beading roller can be rotated about a second axis of rotation along the longitudinal axis of the common spindle. The longitudinal axis of the common spindle and the axis of rotation of the receiving unit are oriented parallel to one another.

SUMMARY

The present application provides an improved device for flanging a tube end that can be operated as economically as possible.

The device for flanging a tube end has a receiving unit for the workpiece to be flanged, and at least one tool holder. At least one flanging roller is fastened to the at least one tool holder by way of a spindle. The flanging roller can in this case be rotated about an axis of rotation along the longitudinal axis of the spindle. The longitudinal axis of the receiving unit and the axis of rotation of the spindle of the flanging roller are oriented at an angle relative to one another. The axis of rotation of the flanging roller rises towards the longitudinal axis of the receiving unit. The axis of rotation of the flanging roller is inwardly inclined and converges towards the longitudinal axis above the workpiece. The axis of rotation of the flanging roller does not intersect the workpiece.

When using a plurality of flanging rollers, their axes of rotation are inwardly inclined, converge towards the longitudinal axis of the receiving unit, and are aligned with one another in an approximately tent-shaped manner. The axes of rotation of the flanging rollers and the longitudinal axis of the receiving unit preferably intersect above the workpiece. The axes of rotation of the flanging rollers converge above the flanging rollers.

The orientation of the axis of rotation of the flanging roller at an angle relative to the longitudinal axis of the receiving unit can reduce particle formation during flanging. This results in reduced wear of the flanging rollers and therefore in an increase in the service life of the flanging rollers.

The receiving unit can be a receiving mandrel, for example. The receiving unit can be structurally connected to the device or be designed as a separate component.

In a first embodiment, the receiving unit for the workpiece to be flanged can be rotated about a first axis of rotation located in the longitudinal axis of the receiving unit. As an alternative thereto, the device itself can be rotated about a first axis of rotation located in the longitudinal axis of the receiving unit.

The longitudinal axis of the receiving unit and the axis of rotation of the flanging roller can preferably be oriented at an angle of approximately 2 to 45 degrees, in particular at an angle of approximately 10 to 30 degrees, in particular at an angle of approximately 15 to 25 degrees, preferably at an angle of approximately 20 degrees, relative to one another. Such an orientation allows a clean flange contour to be produced throughout the entire shaping process, since the flanging rollers contact the workpiece only on the shaping contour.

The flanging rollers can consist of various materials, for example of PEEK, high-performance plastics, ceramic, hard metal, stainless steel or PU. A combination of a plurality of materials is also possible in principle.

Preferably, the direction of rotation of the first axis of rotation along the longitudinal axis of the receiving unit can run counter to the direction of rotation of the flanging roller and thus of the second axis of rotation. The different directions of rotation enable the process duration to be shortened. In particular, the direction of rotation of the first axis of rotation can run clockwise, whereas the direction of rotation of the flanging roller and thus of the second axis of rotation runs anticlockwise. The flanging rollers are in this case each intended to be designed as traction rollers.

The spindle of the flanging roller can preferably be mounted on the tool holder so as to be height-adjustable. This enables the position of the flange surface to be modified. Such an ability to adjust the height of the flanging roller can be realized in particular by way of a slotted cutout in the spindle of the flanging roller.

In one preferred embodiment, provision can be made for at least one beading roller, which is fastened to the tool holder by way of a second spindle. The beading roller can be rotated about a third axis of rotation. In this case, the axis of rotation of the beading roller is oriented parallel to the longitudinal axis of the receiving unit. This enables channel-like depressions, referred to as beads, to be formed in the workpiece to be flanged. Depending on the desired shape of the beads, it is possible for beading rollers with different outer contours and of different sizes to be used.

In one particularly preferred embodiment, the first spindle of the flanging roller and the second spindle of the beading roller can be fastened to one another in a rotationally secure manner by way of a coupling element. The coupling element can preferably have a depression, which has a polygonal inner contour and is provided on the end side of the first spindle of the flanging roller or of the second spindle of the beading roller. Accordingly, a protruding pin, the outer contour of which corresponds to the inner contour of the depression, can be integrally formed on the end side of the second spindle of the beading roller or of the first shaft of the flanging roller. The spindle with the protruding pin can thus be inserted into the spindle with the depression, in order to fasten the two spindles to one another. The polygonal contour of the depression and of the protruding pin means that it is not possible for the two spindles to rotate with respect to one another. The depression can have, for example, a slot-like design. Such a contour can securely prevent the two shafts from rotating with respect to one another, even in the event of high rotational forces occurring.

At least one adjusting washer can preferably be positioned between the end side of the second spindle of the beading roller and the end side of the first spindle of the flanging roller. The height and the number of the adjusting washers enable the spacing between the flange surface and the at least one bead in the workpiece to be adapted and modified in a structurally simple manner. This enables the height of the flange edge to be set with respect to the beads formed, so that the workpiece cannot slip in the flange contour.

Preferably, the at least one flanging roller can have a central depression in the region of its lower edge face. This enables the flanging roller to be positioned particularly close above the beading roller, so that the flanging roller partially extends beyond the beading roller. The upper bead in the workpiece can thus have a particularly small spacing from the flange surface. Depending on the desired flange contour, this can be required in order to be able to prevent the workpiece from slipping within the flange contour.

In one preferred embodiment, provision can be made for a holding-down clamp, which can be rotated about the axis of rotation of the receiving unit, above the edge to be flanged of the workpiece. The holding-down clamp enables in particular an insert present on the upper edge of the workpiece to be fixed in position, so that said insert cannot slip during flanging. Such an insert can be for example a membrane closure, so that a cannula can be inserted through the membrane into the workpiece—for example into the ampoule. This enables fluids to be removed in portions from the closed workpiece without actually having to open it.

Preferably, a primary packaging can be positioned in the workpiece to be flanged. In this case, the free edge of the workpiece to be flanged is flanged around the edge of the primary packaging. In this case, the primary packaging can in particular be made of a plastic material. In this case, the workpiece to be flanged can be designed, for example, as an aluminum can or as a steel can. A hold-down device can also be used, by which the primary packaging can be fixed in position within the workpiece to be flanged. In this case, the at least one beading roller can in particular have two beads. The upper bead creates an additional seal between the primary packaging and the workpiece to be flanged. The lower bead, on the other hand, fixes the primary packaging so that it can no longer move in the longitudinal direction within the workpiece. By tilting the at least one flanging roller, better pressure can be exerted on the top of the primary packaging, resulting in a clean and visually appealing contour of the workpiece as packaging for the primary packaging.

Preferably, provision can be made for a plurality of tool holders, which are distributed circumferentially around the receiving unit. In particular, provision can be made for three or five tool holders.

The workpiece to be flanged can be in particular a vessel-like or sleeve-like object.

Further advantages and features of the invention can be taken from the features additionally specified in the claims and from the exemplary embodiments below.

BRIEF DESCRIPTION OF THE DRAWINGS

The invention will be described and explained in more detail below on the basis of the exemplary embodiments shown in the drawing, in which.

DETAILED DESCRIPTION

Figure 1:
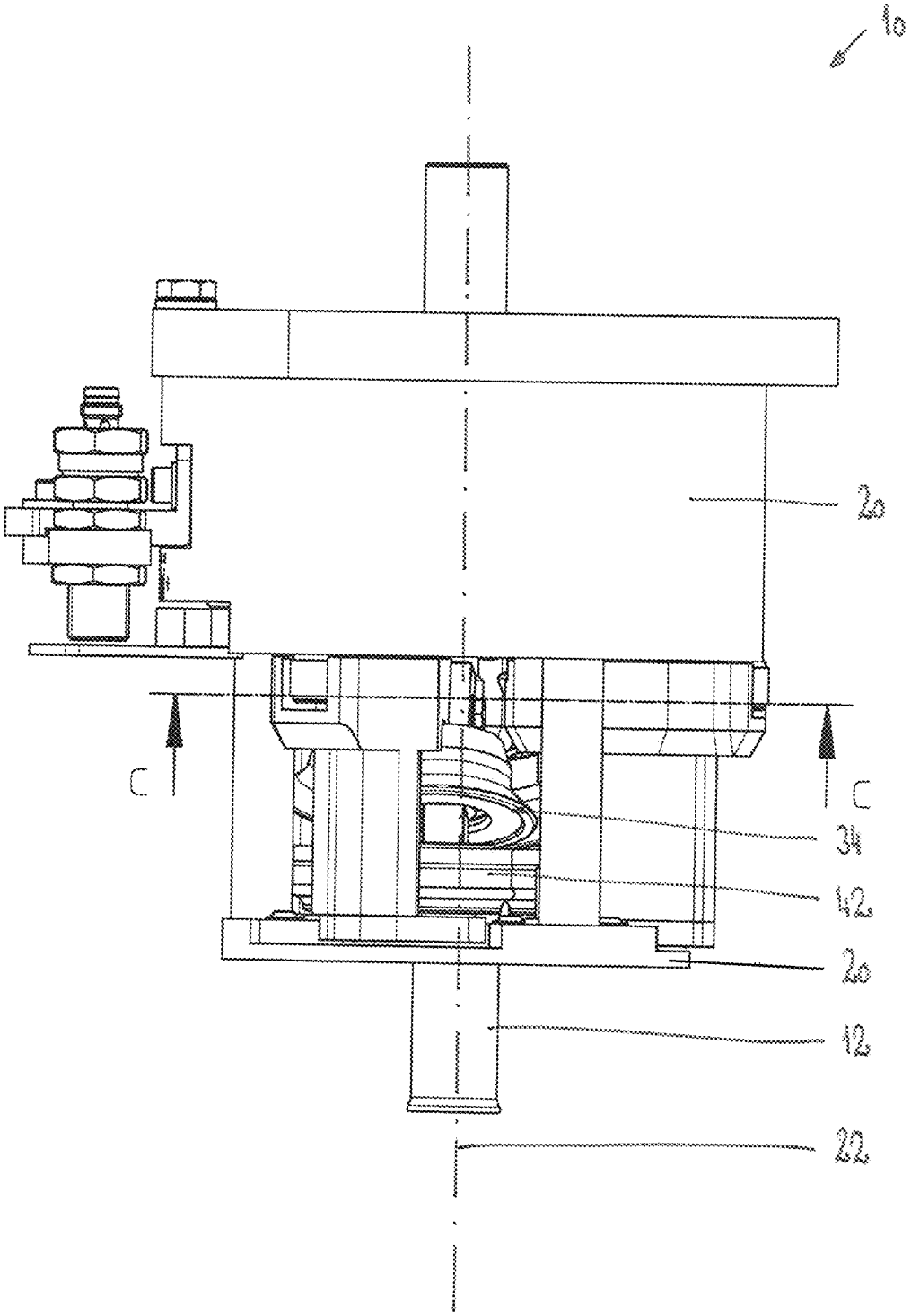
FIG. 1 shows a schematic side view of the device for flanging a tube end.

The device 10 for flanging a workpiece 12 is shown in FIGS. 1 to 6.

The device 10 has a receiving unit 20, which can rotate about a first axis of rotation 22 along its longitudinal axis. To this end, the receiving unit 20 can be set in rotation by a motorized drive, which is not shown here. In the present example, the direction of rotation 24 of the receiving unit 20 runs clockwise. A workpiece 12 can be releasably fastened to the receiving unit 20 in order to flange the end region of the workpiece 12. In the present example, the receiving unit 20 is integrated into the device 10. In contrast thereto, the receiving unit 20 could also be designed as a separate component, for example as a receiving mandrel.

In contrast to the exemplary embodiment shown here, it would also be possible for the receiving unit 20 to have a stationary design and for the rest of the device 10 to rotate about the longitudinal axis of the receiving unit.

Figure 2:
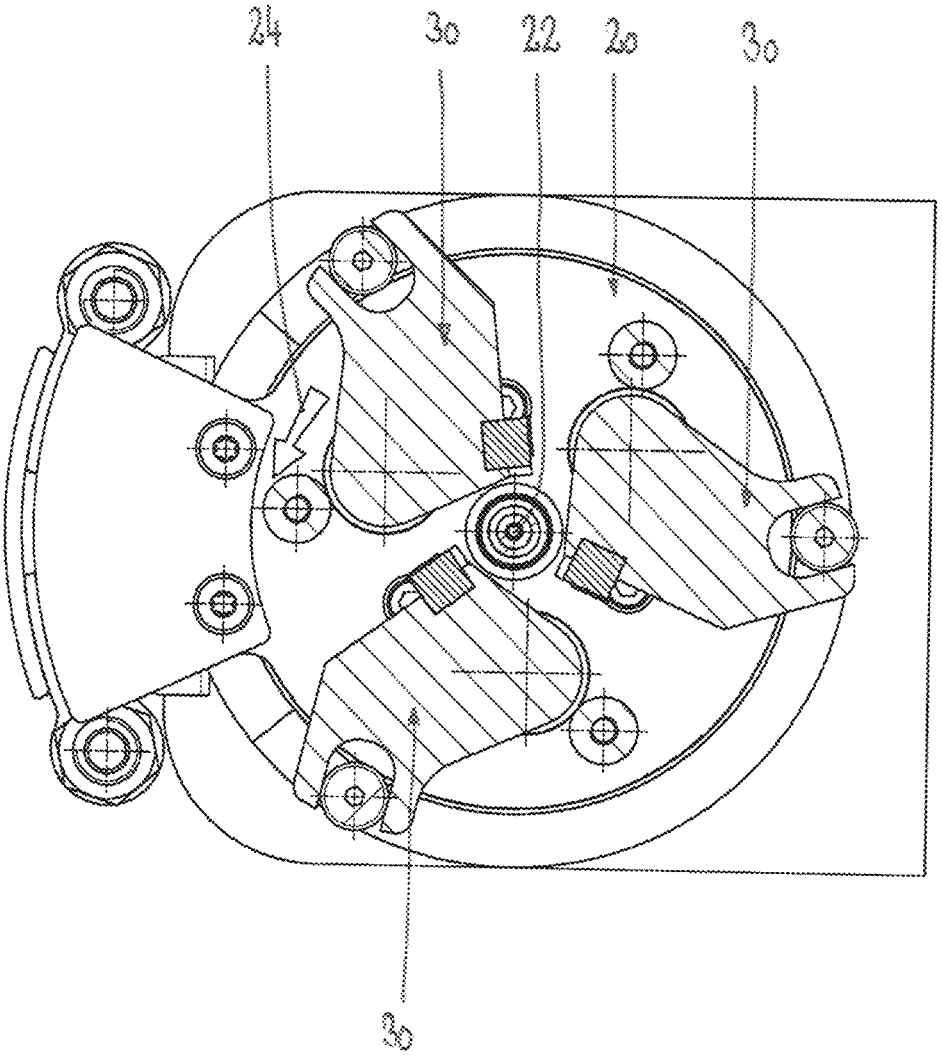
FIG. 2 shows a cross section through the device along the line C-C according to FIG. 1.
Figure 3:
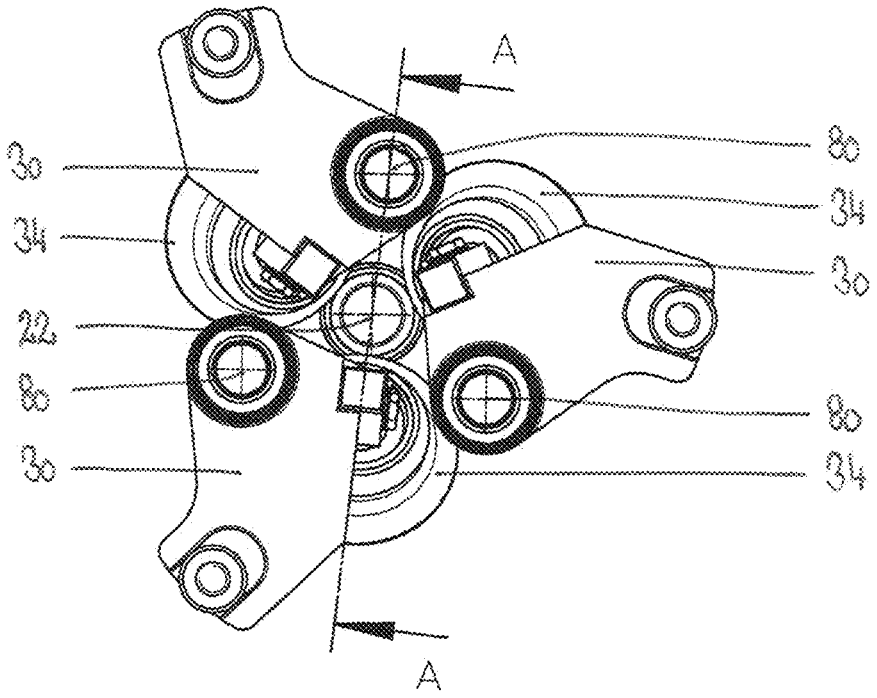
FIG. 3 shows a plan view of the three tool holders of the device according to FIGS. 1 and 2.

In the present example, the device 10 has three tool holders 30 (see in particular FIG. 2). The tool holders 30 are distributed circumferentially around the receiving unit 20. In principle, it is also possible for more or fewer tool holders 30 to be provided, for example five tool holders 30. The individual tool holders 30 are in this case each intended to be arranged as uniformly as possible around the receiving unit 20.

Each tool holder 30 has a first spindle 32, which is fastened to the tool holder 30 in a rotationally secure manner. A bell-like flanging roller 34 is rotatably mounted on this first spindle 32. The flanging roller 34 can be rotated about a second axis of rotation 36 located in the longitudinal axis of the second spindle 32. In the present example, the direction of rotation of the spindle 32 runs anticlockwise and thus counter to the direction of rotation 24 of the receiving unit 20. In the present example, the axis of rotation 36 of the flanging roller 34 runs at an angle 38 of approximately 20 degrees relative to the axis of rotation 22 of the receiving unit 20. The slope 39 of the axis of rotation 36 extends upwardly towards the longitudinal axis 22 of the receiving unit 20 and is thus inwardly inclined.

The orientation of the axis of rotation 36 of the flanging roller 34 at an angle relative to the axis of rotation 22 of the receiving unit 20 leads to reduced particle formation on the workpiece 12 during adjustment of the tool holders 30 and thus during flanging of the workpiece 12. A parallel orientation of the axis of rotation 22 of the receiving unit 20 and the axis of rotation 36 of the flanging roller 34 leads to two points of contact between the flanging roller 34 and the flange surface. This results in groove formation on the flange surface and in adhesion of material to the flanging rollers 34. By contrast, the orientation at an angle of the axis of rotation 22 of the receiving unit 20 and the axis of rotation 36 of the flanging roller 34 leads to just one single point of contact between the flanging roller 34 and the flange surface. This enables groove formation to be prevented, thereby resulting in an improved flange surface and thus in a particularly high-quality visual appearance of the upper edge of the workpiece. At the same time, this leads to reduced wear of the flanging rollers 34, since the adhesion of particles to the flanging rollers 34 is reduced. This enables the service life of the flanging rollers 34 to be extended. This also enables machine shutdowns to be reduced, since fewer cleaning and maintenance operations are required.

The inclination of the axis of rotation 36 and thus the angle 38 can preferably be set in a variable manner. This can take place in particular by way of corresponding guide elements on the tool holder 30. This makes it possible to adapt to different shapes and sizes of workpieces 12.

Furthermore, a second spindle 40 is fastened to the tool holders 30. A beading roller 42 is rotatably mounted on this second spindle 40. The beading roller 42 can be rotated about a third axis of rotation 44 located in the longitudinal axis of the second spindle 40. In the present example, the direction of rotation of the beading roller 42 runs anticlockwise and thus counter to the direction of rotation 24 of the receiving unit 20. In the present example, the axis of rotation 44 of the beading roller 42 runs parallel to the axis of rotation 22 of the receiving unit 20. In the present example, the flanging rollers 34 and the beading rollers 42 can be set in rotation independently of one another.

In the present case, the beading rollers 42 have two encircling protruding webs 46, 48, which run in parallel and are arranged at a certain mutual spacing from one another. In this case, the lower protruding web 48 is more prominent than the upper protruding web 46. Corresponding notches (beads) can be formed in the upper edge of the workpiece 12 by means of the protruding webs 46, 48.

In order to be able to set the spacing between the beads formed, and thus between the protruding webs 46, 48 of the beading rollers 42 and of the flange surface 50, the spindle 32 of the flanging roller 34 is mounted on the tool holder 30 so as to be height-adjustable. In the present example, provision is made in the spindle 32 of the flanging roller 34 for a slotted cutout 52. A fastening screw 54 can be arranged in this slotted cutout 52 so as to be longitudinally displaceable, wherein the fastening screw 54 can be displaced up and down within the slotted cutout 52, so that the spindle 32 is fastened to the tool holder 30 so as to be height-adjustable.

If the upper protruding web 46 of the beading roller 42 and the flange surface 50 have a certain mutual spacing, the lower edge face 60 of the flanging roller 34 can have a planar design. In the present example, said spacing is too small, so that the lower edge face 60 of the flanging roller 34 has a central depression 62. This central depression 62 enables the flanging roller 34 to extend beyond the upper edge region of the beading roller 42, so that the flange surface 50 can run very close to the upper protruding web 46.

Figure 4:
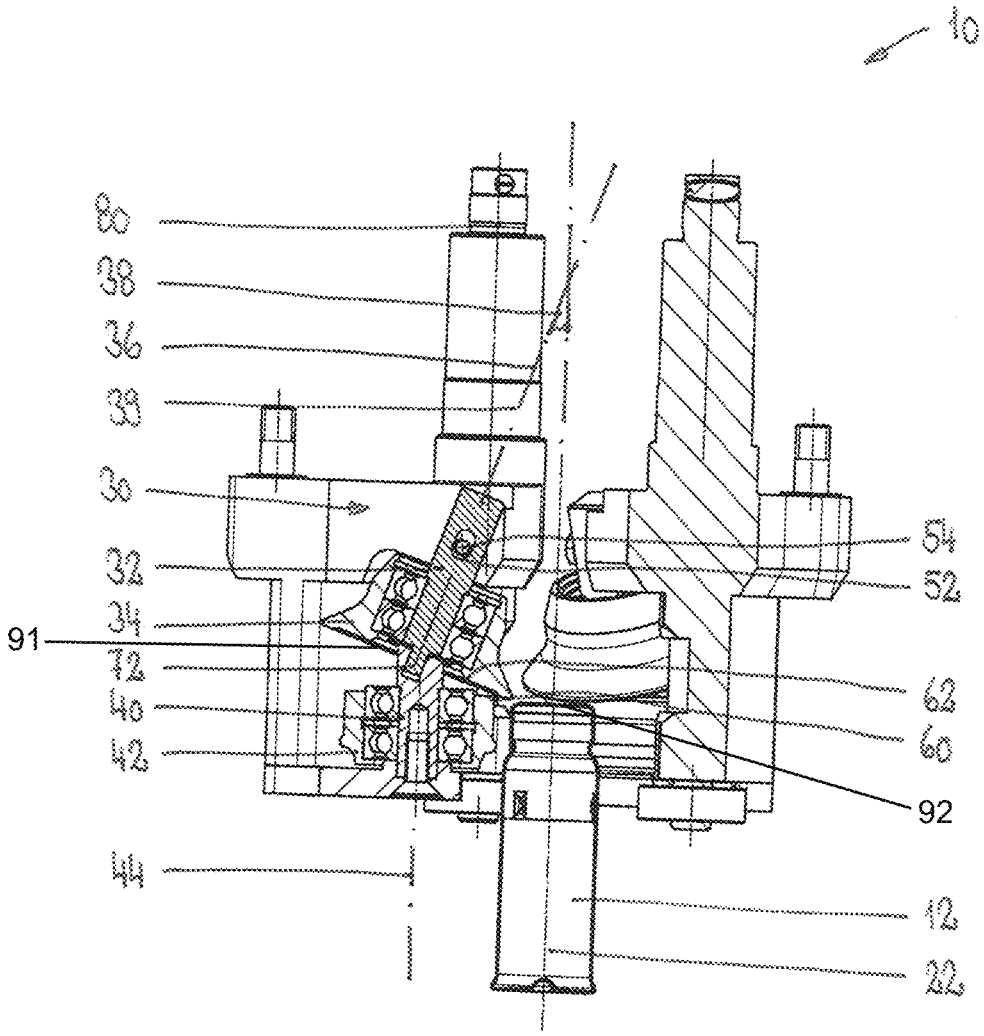
FIG. 4 shows a longitudinal section through the device according to FIG. 3 along the line A-A.
Figure 5:
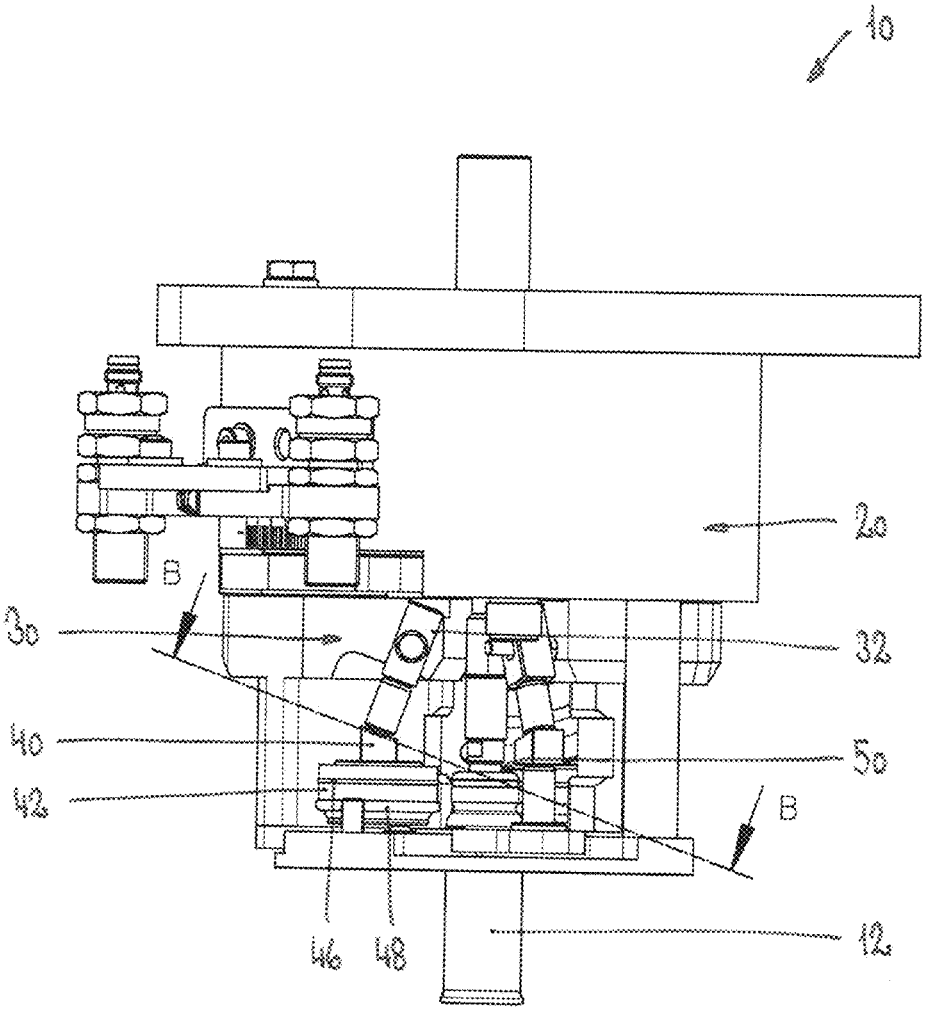
FIG. 5 shows a schematic side view of the device with flanging rollers removed.
Figure 6:
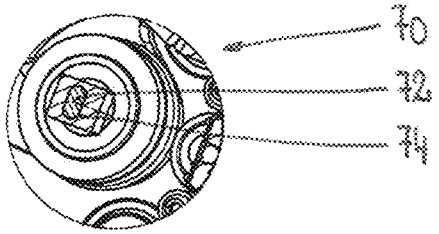
FIG. 6 shows a detail of a cross section through the device according to FIG. 5 along the line B-B looking at the beading roller.

The spindle 32 of the flanging roller 34 and the spindle 40 of the beading roller 42 are each fastened to one another in a rotationally secure manner by way of a coupling element 70 (see FIGS. 4 to 6). In the present example, the coupling element 70 is formed by a protruding pin 72 on the end side of the spindle 32 of the flanging roller 34 and by a depression 74 on the end side of the spindle 40 of the beading roller 42. In the present example, the depression 74 has a slot-like inner contour; the protruding pin 72 has a corresponding outer contour. The protruding pin 72 thus sits in the depression 74 in a rotationally secure manner. In contrast to the exemplary embodiment shown here, the protruding pin 72 could also be integrally formed on the end side of the spindle 40 of the beading roller 42. Accordingly, in this case, the depression 74 would be provided on the end side of the spindle 32 of the flanging roller 34.

The spacing of the end side of the spindle 32 of the flanging roller 34 from the end side of the spindle 40 of the beading roller 42 can be adapted by one or more adjusting washers 76. In the present example, a single adjusting washer 76 is provided (see FIG. 4).

In the present example, the individual tool holders 30 can be pivoted via a further axis of rotation 80, which runs parallel to the longitudinal axis 22 of the receiving unit. As a result, the tool holders 30 and thus also the flanging rollers 34 and the beading rollers 42 can be advanced, so that the distance to the workpiece 12 to be flanged is reduced. This advancement takes place in parallel, so that the alignment of the flanging rollers 34 or the beading rollers 42 relative to the workpiece 12 does not change.

The lower edge face 60 of the flanging roller 34 is arranged in a flange plane 91. The tube end of the workpiece 12 is arranged in a tube face plane 92. The flange plane 91 and the tube face plane 92 intersect at a clearance angle. The longitudinal axis 22 extends at a right angle through the tube face plane 92. The axis of rotation 36 extends at a right angle through the flange plane 91. Therefore, the clearance angle corresponds to the angle 38. Setting the clearance angle within the specified range of 10 to 30 degrees, in particular 15 to 25 degrees, preferably at an angle of approximately 20 degrees (20°±2.5°) has a significant advantage. This defined clearance angle allows flanging to be performed without lubrication. Formation of abrasive particles is minimized. The surface area in which the flanging roller 34 pushed against the workpiece 12 is minimal, and nearly reduced to a single point.

What is claimed is:

1. A device (10) for flanging a tube end of a workpiece (12), comprising:

a receiving unit (20) for the workpiece (12) to be flanged;

a tool holder (30);

a flanging roller (34), which is fastened to the tool holder (30) by a spindle (32); and a beading roller (42), which is fastened to the tool holder (30) by a second spindle (40), wherein the flanging roller (34) can be rotated about an axis of rotation (36) along a longitudinal axis of the spindle (32), and wherein a longitudinal axis (22) of the receiving unit (20) and the axis of rotation (36) of the flanging roller (34) are oriented at an angle relative to one another, and wherein the axis of rotation (36) of the flanging roller (34) is inwardly inclined and converges towards the longitudinal axis (22) above the workpiece, wherein the beading roller (42) can be rotated about a third axis of rotation (44) along the longitudinal axis of the second spindle (40), and wherein the third axis of rotation (44) of the beading roller (42) is oriented parallel to the longitudinal axis (22) of the receiving unit (20).

2. The device according to claim 1, wherein the longitudinal axis (22) of the receiving unit (20) and the axis of rotation (36) of the flanging roller (34) are oriented at an angle (38) of 15 to 25 degrees relative to one another.

3. The device according to claim 1, wherein the receiving unit (20) is configured to rotate about the longitudinal axis (22) in a direction of rotation that runs counter to a direction of rotation of the flanging roller (34).

4. The device according to claim 1, wherein the spindle (32) of the flanging roller (34) is mounted on the tool holder (30) so as to be height-adjustable.

5. A device (10) for flanging a tube end of a workpiece (12), comprising:

a receiving unit (20) for the workpiece (12) to be flanged;

a tool holder (30); and a flanging roller (34), which is fastened to the tool holder (30) by a spindle (32), wherein the flanging roller (34) can be rotated about an axis of rotation (36) along a longitudinal axis of the spindle (32), and wherein a longitudinal axis (22) of the receiving unit (20) and the axis of rotation (36) of the flanging roller (34) are oriented at an angle relative to one another, and wherein the axis of rotation (36) of the flanging roller (34) is inwardly inclined and converges towards the longitudinal axis (22) above the workpiece, and wherein the spindle (32) of the flanging roller (34) is mounted on the tool holder (30) so as to be height-adjustable, and wherein the spindle (32) of the flanging roller (34) is mounted on the tool holder (30) by a slotted cutout (52).

6. The device according to claim 5, further comprising a beading roller (42), which is fastened to the tool holder (30) by a second spindle (40), wherein the beading roller (42) can be rotated about a third axis of rotation (44) along the longitudinal axis of the second spindle (40), and wherein the third axis of rotation (44) of the beading roller (42) is oriented parallel to the longitudinal axis (22) of the receiving unit (20).

7. The device according to claim 6, wherein the spindle (32) of the flanging roller (34) and the second spindle (40) of the beading roller (42) are fastened to one another in a rotationally secure manner by a coupling element (70).

8. The device according to claim 7, wherein the coupling element (70) has a depression (74) with a polygonal inner contour provided on an end side of the spindle (32) of the flanging roller (34) and a protruding pin (72) having an outer contour that corresponds to the polygonal inner contour of the depression (74) integrally formed on an end side of the second spindle (40) of the beading roller (42), or a depression (74) with a polygonal inner contour provided on an end side of the second spindle (40) of the beading roller (42) and a protruding pin (72) having an outer contour that corresponds to the polygonal inner contour of the depression (74) integrally formed on an end side of the spindle (32) of the flanging roller (34).

9. The device according to claim 6, wherein the flanging roller (34) has a central depression (62) in a region of its lower edge face (60).

10. A device (10) for flanging a tube end of a workpiece (12), comprising:

a receiving unit (20) for the workpiece (12) to be flanged;

a tool holder (30); and a flanging roller (34), which is fastened to the tool holder (30) by a spindle (32), wherein the flanging roller (34) can be rotated about an axis of rotation (36) along a longitudinal axis of the spindle (32), and wherein a longitudinal axis (22) of the receiving unit (20) and the axis of rotation (36) of the flanging roller (34) are oriented at an angle relative to one another, and wherein the axis of rotation (36) of the flanging roller (34) is inwardly inclined and converges towards the longitudinal axis (22) above the workpiece, further comprising a holding-down clamp positioned in the longitudinal axis (22) of the receiving unit (20).

11. A device (10) for flanging a tube end of a workpiece (12), comprising:

a receiving unit (20) for the workpiece (12) to be flanged;

a plurality of tool holders (30); and a plurality of flanging rollers (34), each of the flanging rollers (34) being fastened to one of the tool holders (30) by a respective spindle (32), wherein each of the flanging rollers (34) can be rotated about a respective axis of rotation (36) along a longitudinal axis of the respective spindle (32), and wherein the axes of rotation (36) of the flanging rollers (34) are inwardly inclined and converge towards the longitudinal axis (22) above the flanging rollers (34).

12. The device (10) as in claim 11, wherein a lower edge face (60) of each flanging roller (34) is arranged in a respective flange plane (91), and wherein the tube end of the workpiece (12) is arranged in a tube face plane (92), and wherein each respective flange plane (91) and the tube face plane (92) intersect at a clearance angle between 15 and 25 degrees.

* * * * *